US011660515B1

(12) United States Patent
Walker-Stern et al.

(10) Patent No.: US 11,660,515 B1
(45) Date of Patent: May 30, 2023

(54) MOLDED HOCKEY PUCK WITH ELECTRONIC SIGNAL TRANSMITTER CORE

(71) Applicant: SportsMEDIA Technology Corporation, Durham, NC (US)

(72) Inventors: Isaac Walker-Stern, Portland, OR (US); Trevor Davidson, Durham, NC (US); Matthew Bertram, Phoenix, AZ (US)

(73) Assignee: SPORTSMEDIA TECHNOLOGY CORPORATION, Durham, NC (US)

( * ) Notice: Subject to any disclaimer, the term of this patent is extended or adjusted under 35 U.S.C. 154(b) by 0 days.

(21) Appl. No.: 17/817,848

(22) Filed: Aug. 5, 2022

(51) Int. Cl.

| | |
|---|---|
| ***A63B 67/14*** | (2006.01) |
| ***A63B 69/00*** | (2006.01) |
| ***A63B 71/06*** | (2006.01) |
| ***A63B 24/00*** | (2006.01) |
| ***A63B 102/24*** | (2015.01) |

(52) U.S. Cl.
CPC ..... *A63B 67/14* (2013.01); *A63B 24/0021* (2013.01); *A63B 69/0026* (2013.01); *A63B 71/06* (2013.01); *A63B 2024/0028* (2013.01); *A63B 2102/24* (2015.10); *A63B 2225/50* (2013.01); *A63B 2225/74* (2020.08)

(58) Field of Classification Search
CPC . A63B 67/14; A63B 24/0021; A63B 69/0026; A63B 71/06; A63B 2024/0028; A63B 2102/24; A63B 2225/50; A63B 2225/74
See application file for complete search history.

(56) References Cited

U.S. PATENT DOCUMENTS

| | | | |
|---|---|---|---|
| 2,020,484 | A | 11/1935 | Turner |
| 2,425,966 | A | 8/1947 | Tjomsland |
| 2,640,699 | A | 6/1953 | Garbo |
| 3,679,212 | A | 7/1972 | Smith |
| 3,704,891 | A | 12/1972 | Chiarelli |
| 4,078,801 | A | 3/1978 | White |
| 4,153,253 | A | 5/1979 | White |
| 4,183,536 | A | 1/1980 | Platt |
| 4,846,475 | A | 7/1989 | Newcomb et al. |

(Continued)

FOREIGN PATENT DOCUMENTS

EP 1010129 B1 * 3/2007 ..... G06K 9/209

*Primary Examiner* — Jeffrey S Vanderveen
(74) *Attorney, Agent, or Firm* — Neo IP

(57) ABSTRACT

A hockey puck is formed as two mating subcomponents encapsulating an internal signal transmitter. The hockey puck includes holes extending from an external surface of the hockey puck into an internal void formed between the two mating subcomponents. The internal signal transmitter includes protrusions extending into the holes, each including a surface-mounted diode. The surface-mounted diodes include no lens cap, allowing the diodes to be positioned closer to the external surface of the puck than existing pucks. For improved visibility, the diode is positioned less than 5 mm from the external surface of the puck, but greater than 1 mm from the external surface of the puck, in order to prevent the diodes from being externally visible. Preferably, the diodes are positioned between approximately 2 mm and approximately 3 mm from the external surface of the hockey puck.

20 Claims, 13 Drawing Sheets
(2 of 13 Drawing Sheet(s) Filed in Color)

(56) References Cited

U.S. PATENT DOCUMENTS 4,878,668 A 11/1989 Nevoral
4,968,036 A 11/1990 Mark
4,991,847 A 2/1991 Rudell et al.
5,014,990 A 5/1991 Kaser et al.
5,207,720 A 5/1993 Shepherd
5,348,298 A 9/1994 Montgomery
5,366,219 A 11/1994 Salcer et al.
5,388,825 A 2/1995 Myers et al.
5,408,264 A 4/1995 Kurata et al.
5,429,359 A 7/1995 Timperman et al.
5,518,237 A 5/1996 Bellehumeur
5,526,326 A 6/1996 Fekete et al.
5,564,698 A 10/1996 Honey et al.
5,718,648 A 2/1998 Savio
5,743,815 A 4/1998 Helderman
5,792,012 A 8/1998 Dudley
5,910,057 A 6/1999 Quimby et al.
5,912,700 A 6/1999 Honey et al.
5,946,643 A 8/1999 Zakutin
5,976,042 A 11/1999 LaMarche et al.
6,042,487 A 3/2000 Schrimmer et al.
6,089,998 A 7/2000 O'Neal et al.
6,113,504 A 9/2000 Kuesters
6,117,030 A 9/2000 Green
6,126,561 A * 10/2000 Mark ..... A63B 67/14 473/588
6,252,632 B1 * 6/2001 Cavallaro ..... H04N 5/262 348/592
6,428,432 B1 8/2002 Kachel
6,450,661 B1 9/2002 Okumura
6,799,862 B2 10/2004 Galli
7,088,222 B1 8/2006 Dueker et al.
7,163,313 B2 1/2007 Rosenberg
7,621,833 B2 11/2009 Proulx et al.
7,785,215 B2 8/2010 Kohnen
7,811,163 B2 10/2010 Ratcliffe
7,849,740 B2 12/2010 Nichol
8,622,857 B2 1/2014 Lo
8,727,918 B1 5/2014 Gentile
8,727,919 B1 5/2014 Gentile
9,227,112 B2 1/2016 Kodama et al.
9,279,557 B2 3/2016 Su
9,320,981 B2 4/2016 Dawson
9,463,360 B1 10/2016 Richard
9,557,038 B2 1/2017 Blair et al.
9,596,829 B2 3/2017 Wolfe, Jr. et al.
9,597,569 B2 3/2017 Pederson
9,674,435 B1 6/2017 Monari et al.
9,757,633 B2 9/2017 Bauman
9,791,246 B2 10/2017 D'Andrade
9,873,064 B1 1/2018 Adkins et al.
10,016,669 B2 7/2018 Mason et al.
10,029,155 B1 7/2018 Lo
D827,219 S 8/2018 Fan et al.
10,343,042 B2 7/2019 Mason et al.
10,507,374 B2 12/2019 Kounellas
10,537,778 B2 1/2020 Mayer et al.
10,722,773 B2 7/2020 Houlihan
10,874,902 B1 12/2020 Near
11,000,750 B2 5/2021 Kounellas et al.
11,202,949 B2 12/2021 Hall et al.
2002/0137582 A1 9/2002 Yu
2004/0022070 A1 2/2004 Moore
2004/0138595 A1 7/2004 Fang
2005/0085316 A1 4/2005 Barr
2007/0247439 A1 10/2007 Daniel et al.
2007/0275801 A1 11/2007 Proulx et al.
2008/0039246 A1 2/2008 Martino
2011/0214616 A1 9/2011 Levin et al.
2011/0244981 A1 10/2011 Schrimmer et al.
2012/0169589 A1 7/2012 Albano et al.
2012/0287611 A1 11/2012 Wilson et al.
2013/0025543 A1 1/2013 Ottosson
2013/0167290 A1 7/2013 Ezra
2013/0210562 A1 8/2013 Zawitz
2014/0127967 A1 5/2014 Liao
2014/0194232 A1 7/2014 Krysiak et al.
2014/0194258 A1 7/2014 Shorter
2014/0309059 A1 10/2014 Minch
2016/0273738 A1 9/2016 Wolfinbarger
2017/0246513 A1 8/2017 Fang
2018/0065012 A1 3/2018 Mason et al.
2018/0326276 A1 11/2018 Mason et al.
2019/0036360 A1 1/2019 Zilles et al.
2019/0344143 A1 11/2019 Mason et al.
2020/0276487 A1 9/2020 Hall et al.
2020/0324185 A1 10/2020 Hulkki
2020/0398111 A1 * 12/2020 Near ..... A63B 71/0622
2021/0077862 A1 3/2021 Hutt
2022/0105404 A1 4/2022 Hall et al.

* cited by examiner

PRIOR ART FIG. 1

PRIOR ART FIG. 2

MOLDED HOCKEY PUCK WITH ELECTRONIC SIGNAL TRANSMITTER CORE

BACKGROUND OF THE INVENTION

1. Field of the Invention

The present invention relates to hockey pucks with built-in electromagnetic indicators, and more specifically to hockey pucks having built-in light-emitting devices proximate to the surface of the hockey pucks for improved detectability.

2. Description of the Prior Art

Despite the current popularity of hockey, television viewing is hampered by the poor visibility of the hockey puck as it moves around the ice at high speeds. In order to be able to view all areas of the ice rink, cameras must be located far from the ice rink. Thus, a standard hockey puck tends to appear as a small dot on the screen. As a result, it is difficult to follow the puck as it is passed from player to player, and it is especially difficult to follow the puck as it is shot toward the goal and either deflected, caught or missed by the goalie. Often, viewers recognize a score only when a signal light is lit or the announcer informs the viewer that a goal has been scored.

Pucks, such as that described in US Patent Publication No. 2022/0104504, have been invented that include internal LED devices designed to be detected during play for improved visibility.

Prior Art Patent Documents Include the Following:

US Patent Publication No. 2022/0105404 for Molded hockey puck with electronic signal transmitter core by inventors Hall et al., filed Dec. 17, 2021 and published Apr. 7, 2022, discloses a hockey puck including an internal signal transmitter enabling instantaneous identification of its position as it moves around. The puck includes two molded subcomponents, which encapsulate the signal transmitter. The signal transmitter includes driver electronics and a number of signal transmitters which together generate and emit an electromagnetic signal. The electromagnetic signal is emitted by a plurality of diodes mounted in light pipes enclosed within cavities in the subcomponents that extend to outer surfaces of the hockey puck components. The puck includes two subcomponents that are attached via complimentary sets of concentrically arranged wedges.

U.S. Pat. No. 11,202,949 for Molded hockey puck with electronic signal transmitter core by inventors Hall et al., filed Sep. 3, 2020 and issued Dec. 21, 2021, discloses a hockey puck including an internal signal transmitter enabling instantaneous identification of its position as it moves around. The puck includes two molded subcomponents, which encapsulate the signal transmitter. The signal transmitter includes driver electronics and a number of signal transmitters which together generate and emit an electromagnetic signal. The electromagnetic signal is emitted by a plurality of diodes mounted in light pipes enclosed within cavities in the subcomponents that extend to outer surfaces of the hockey puck components. The puck includes two subcomponents that are attached via complimentary sets of concentrically arranged wedges.

US Patent Publication No. 2019/0344143 for Molded hockey puck with electronic signal transmitter core by inventors Mason et al., filed Jul. 3, 2019 and published Nov. 14, 2019, discloses a hockey puck including an internal signal transmitter enabling instantaneous identification of its position as it moves around. The puck includes two molded subcomponents, which encapsulate the signal transmitter. The signal transmitter includes driver electronics and a number of signal transmitters which together generate and emit an electromagnetic signal. The electromagnetic signal is emitted by a plurality of diodes mounted in cavities in the subcomponents, for example around an outer circumference of the hockey puck and through a top and bottom surfaces of the hockey puck. The puck is alternatively formed of a material that allows electromagnetic radiation to be emitted through the subcomponents, and the diode cavities omitted.

U.S. Pat. No. 10,343,042 for Molded hockey puck with electronic signal transmitter core by inventors Mason et al., filed Jul. 5, 2018 and issued Jul. 9, 2019, discloses a hockey puck including an internal signal transmitter enabling instantaneous identification of its position as it moves around. The puck includes two molded subcomponents, which encapsulate the signal transmitter. The signal transmitter may include driver electronics and a number of signal transmitters which together generate and emit an electromagnetic signal. The electromagnetic signal may be emitted by a plurality of diodes mounted in cavities in the subcomponents, for example around an outer circumference of the hockey puck and through a top and bottom surfaces of the hockey puck. The puck may alternatively be formed of a material that allows electromagnetic radiation to be emitted through the subcomponents, and the diode cavities may be omitted.

U.S. Pat. No. 10,016,669 for Molded hockey puck with electronic signal transmitter core by inventors Mason et al., filed Sep. 8, 2016 and issued Jul. 10, 2018, discloses a hockey puck including an internal signal transmitter enabling instantaneous identification of its position as it moves around. The puck includes two molded subcomponents, which encapsulate the signal transmitter. The signal transmitter may include driver electronics and a number of signal transmitters which together generate and emit an electromagnetic signal. The electromagnetic signal may be emitted by a plurality of diodes mounted in cavities in the subcomponents, for example around an outer circumference of the hockey puck and through a top and bottom surfaces of the hockey puck. The puck may alternatively be formed of a material that allows electromagnetic radiation to be emitted through the subcomponents, and the diode cavities may be omitted.

U.S. Pat. No. 11,000,750 for Infrared hockey puck and goal detection system by inventors Kounellas et al., filed Oct. 21, 2019 and issued May 11, 2021, discloses a two-part system including a modified hockey puck and a set of goal units that can be mounted on a hockey goal. Within the puck are light sources, motion sensors, infrared transmitters, and a power source. Within the goal units are light sources, infrared sensors, and a microcontroller. When the goal units are mounted on the hockey goal, the infrared sensors form a detection area through which the puck must pass in order to count as a goal. The infrared transmitter of the puck and the infrared sensors of the goal units communicate with one another, and when an infrared signal is received the microcontroller triggers the light sources mounted to the goal to illuminate and indicate that a goal has been scored. Additionally, both the puck and the goal units are designed to reduce power consumption by switching between a low-energy mode or an active mode of operation.

US Patent Publication No. 2020/0324185 for Hockey puck and a method for manufacturing the same by inventor Hulkki, filed Dec. 14, 2018 and published Oct. 15, 2020, discloses a hockey puck configured to transmit a radio signal, the hockey puck comprising: a cylindrical body, a radio Transmitter arranged in a cavity inside the cylindrical body, the cavity machined through a cylindrical surface of the cylindrical body, wherein the radio transmitter is positioned in the cavity with a casting material applied to the cavity. Further, the invention relates to a method for manufacturing the hockey puck.

U.S. Pat. No. 7,621,833 for Hockey puck by inventors Proulx et al., filed Dec. 14, 2006 and issued Nov. 24, 2009, discloses a hockey puck comprised of an annular member with a translucent member disposed interior to the annular member. The interface of the annular member and the translucent member is reflective. A light member is disposed in the translucent member to form a hockey puck having symmetrical contact surfaces. A plurality of raised nubs may be located on the first and second opposedly arranged surfaces (faces) of said annular member for playing on non-ice surfaces.

U.S. Pat. No. 5,564,698 for Electromagnetic transmitting hockey puck by inventors Honey et al., filed Jun. 30, 1995 and issued Oct. 15, 1996, describes a hockey puck with an electromagnetic transmitter. The electromagnetic transmitter could include an infrared transmitter, ultraviolet transmitter, radar repeater, RF transmitter or other device for transmitting electromagnetic waves outside of the visible spectrum. The electromagnetic transmitter is turned on using a shock sensor and is turned off using a timer.

SUMMARY OF THE INVENTION

The present invention relates to hockey pucks with built-in electromagnetic indicators, and more specifically to hockey pucks having built-in light-emitting devices proximate to the surface of the hockey pucks for improved detectability.

It is an object of this invention to improve detectability of light indicators within an electronically enabled hockey puck.

In one embodiment, the present invention is directed to a hockey puck, including a first subcomponent matingly attached to a second subcomponent, and a signal transmitter operable to generate and emit electromagnetic radiation, wherein the signal transmitter includes at least one power source and at least one protrusion attached to at least one diode, wherein an interior void is formed between the first subcomponent and the second subcomponent, wherein the signal transmitter is sized to fit within the interior void, wherein the first subcomponent and/or the second subcomponent include one or more holes extending from an external surface of either subcomponent to the interior void, wherein the at least one protrusion of the signal transmitter extends into the one or more holes of the first subcomponent and/or the second subcomponent, wherein the at least one diode is positioned between approximately 2 mm and approximately 3 mm from an external surface of the hockey puck, and wherein the at least one diode is operable to generate visible and/or infrared electromagnetic radiation.

In another embodiment, the present invention is directed to a hockey puck, including a first subcomponent matingly attached to a second subcomponent, and a signal transmitter operable to generate and emit electromagnetic radiation, wherein the signal transmitter includes at least one power source and at least one protrusion attached to at least one diode, wherein an interior void is formed between the first subcomponent and the second subcomponent, wherein the signal transmitter is sized to fit within the interior void, wherein the first subcomponent and/or the second subcomponent include one or more holes extending from an external surface of either subcomponent to the interior void, wherein the at least one protrusion of the signal transmitter extends into the one or more holes of the first subcomponent and/or the second subcomponent, wherein the at least one diode is positioned less than approximately 5 mm from an external surface of the hockey puck, wherein an external opening of each of the one or more holes is sealed with a translucent epoxy, and wherein the at least one diode is operable to generate visible and/or infrared electromagnetic radiation.

In yet another embodiment, the present invention is directed to a hockey puck, including a first subcomponent matingly attached to a second subcomponent, and a signal transmitter operable to generate and emit electromagnetic radiation, wherein the signal transmitter includes at least one power source and at least one protrusion attached to at least one diode, wherein an interior void is formed between the first subcomponent and the second subcomponent, wherein the signal transmitter is sized to fit within the interior void, wherein the first subcomponent and/or the second subcomponent include one or more holes extending from an external surface of either subcomponent to the interior void, wherein the at least one protrusion of the signal transmitter extends into the one or more holes of the first subcomponent and/or the second subcomponent, wherein the at least one diode is positioned less than approximately 5 mm from an external surface of the hockey puck, wherein the at least one diode does not include a lens cap, and wherein the at least one diode is operable to generate visible and/or infrared electromagnetic radiation.

These and other aspects of the present invention will become apparent to those skilled in the art after a reading of the following description of the preferred embodiment when considered with the drawings, as they support the claimed invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
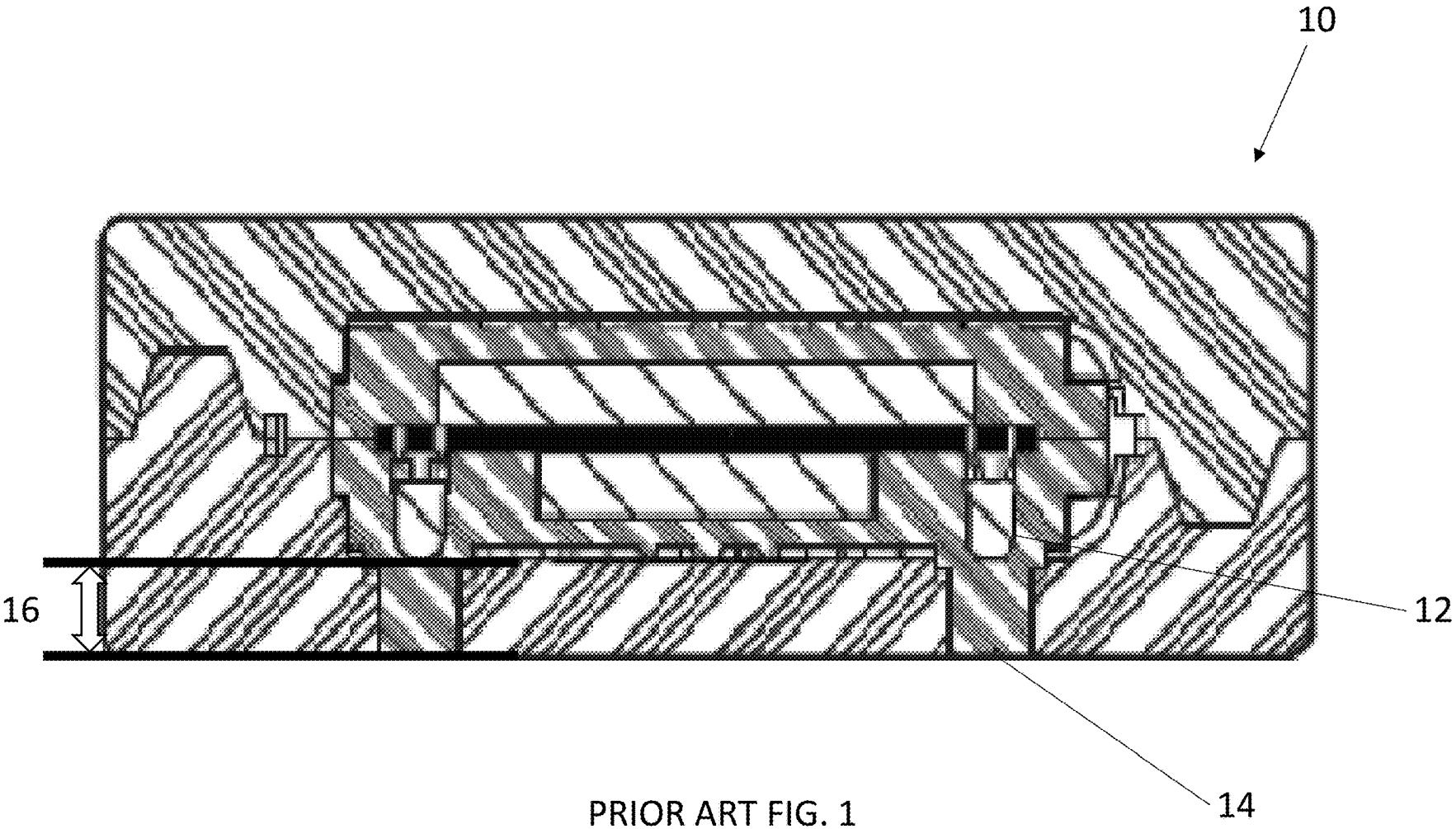
FIG. 1 illustrates a sectional view of a prior art hockey puck including light-emitting diodes (LEDs) offset from openings in the hockey puck.

The present invention relates to hockey pucks with built-in electromagnetic indicators, and more specifically to hockey pucks having built-in light-emitting devices proximate to the surface of the hockey pucks for improved detectability.

In one embodiment, the present invention is directed to a hockey puck, including a first subcomponent matingly attached to a second subcomponent, and a signal transmitter operable to generate and emit electromagnetic radiation, wherein the signal transmitter includes at least one power source and at least one protrusion attached to at least one diode, wherein an interior void is formed between the first subcomponent and the second subcomponent, wherein the signal transmitter is sized to fit within the interior void, wherein the first subcomponent and/or the second subcomponent include one or more holes extending from an external surface of either subcomponent to the interior void, wherein the at least one protrusion of the signal transmitter extends into the one or more holes of the first subcomponent and/or the second subcomponent, wherein the at least one diode is positioned between approximately 2 mm and approximately 3 mm from an external surface of the hockey puck, and wherein the at least one diode is operable to generate visible and/or infrared electromagnetic radiation.

In another embodiment, the present invention is directed to a hockey puck, including a first subcomponent matingly attached to a second subcomponent, and a signal transmitter operable to generate and emit electromagnetic radiation, wherein the signal transmitter includes at least one power source and at least one protrusion attached to at least one diode, wherein an interior void is formed between the first subcomponent and the second subcomponent, wherein the signal transmitter is sized to fit within the interior void, wherein the first subcomponent and/or the second subcomponent include one or more holes extending from an external surface of either subcomponent to the interior void, wherein the at least one protrusion of the signal transmitter extends into the one or more holes of the first subcomponent and/or the second subcomponent, wherein the at least one diode is positioned less than approximately 5 mm from an external surface of the hockey puck, wherein an external opening of each of the one or more holes is sealed with a translucent epoxy, and wherein the at least one diode is operable to generate visible and/or infrared electromagnetic radiation.

In yet another embodiment, the present invention is directed to a hockey puck, including a first subcomponent matingly attached to a second subcomponent, and a signal transmitter operable to generate and emit electromagnetic radiation, wherein the signal transmitter includes at least one power source and at least one protrusion attached to at least one diode, wherein an interior void is formed between the first subcomponent and the second subcomponent, wherein the signal transmitter is sized to fit within the interior void, wherein the first subcomponent and/or the second subcomponent include one or more holes extending from an external surface of either subcomponent to the interior void, wherein the at least one protrusion of the signal transmitter extends into the one or more holes of the first subcomponent and/or the second subcomponent, wherein the at least one diode is positioned less than approximately 5 mm from an external surface of the hockey puck, wherein the at least one diode does not include a lens cap, and wherein the at least one diode is operable to generate visible and/or infrared electromagnetic radiation.

Hockey is one of the most viewed sports, both in the United States and abroad. Unlike sports such as football and basketball, where the central object (i.e., the ball) is fairly large and therefore usually visible on camera, hockey pucks are small and travel very quickly, making viewing them on camera very difficult, especially during times of high intensity play. The difficulty of keeping up with the puck is a commonly cited issue for viewers of hockey, especially newer viewers who are less accustomed to tracking gameplay. In order to improve the viewing experience, solutions have been proposed to increase puck visibility. Because hockey pucks are highly standardized objects and changing the outside shape or texture is likely to impact the game, changes to the exterior of the puck are not feasible solutions. One solution, proposed by U.S. Pat. No. 11,202,949 and shown in Prior Art FIG. 14, which is incorporated herein by reference in its entirety, forms a puck 10 as two separate components surrounding an electronic transmitter module. The puck 10 includes holes 14 leading from an outside surface of the puck 10 into the center of the puck 10. The electronic transmitter module includes protrusions attached to light emitting diodes (LEDs) 12 that extend into the holes 14.

Figure 2:
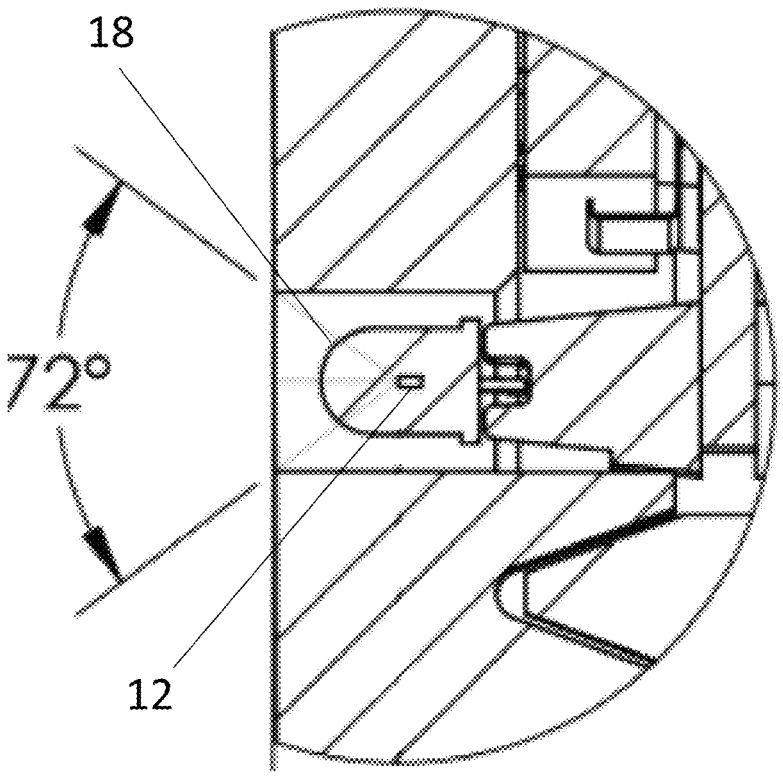
FIG. 2 illustrates the angles at which electromagnetic radiation is able to travel from the LEDs outside of the openings in the hockey puck of FIG. 1.

However, while the puck 10 described in U.S. Pat. No. 11,202,949 provides a substantial improvement over prior art pucks, the prior art puck 10 is able to be improved to provide even greater visibility. As shown in Prior Art FIG. 2, the LEDs 12 within the prior art puck 10 are encased within lens caps 18. Because the LEDs 12 are encased within lens caps 18, the LEDs 12 themselves are offset from the exterior surface of the puck 10 by a distance 16. At minimum the distance 16 is 3.5 mm due to the lens cap, but the '949 patent shows the LED as being even further recessed, with the distance 16 being at least 5-10 mm. As shown in Prior Art FIG. 2, the recession of the LED 12 away from the exterior of the hole means that there is only a 72° arc from which the LED 12 is visible from the outside of the puck 10 (and therefore the light from the LED 12 is only able to directly shine in a 72° arc outside the puck 10).

Referring now to the drawings in general, the illustrations are for the purpose of describing one or more preferred embodiments of the invention and are not intended to limit the invention thereto.

Figure 3:
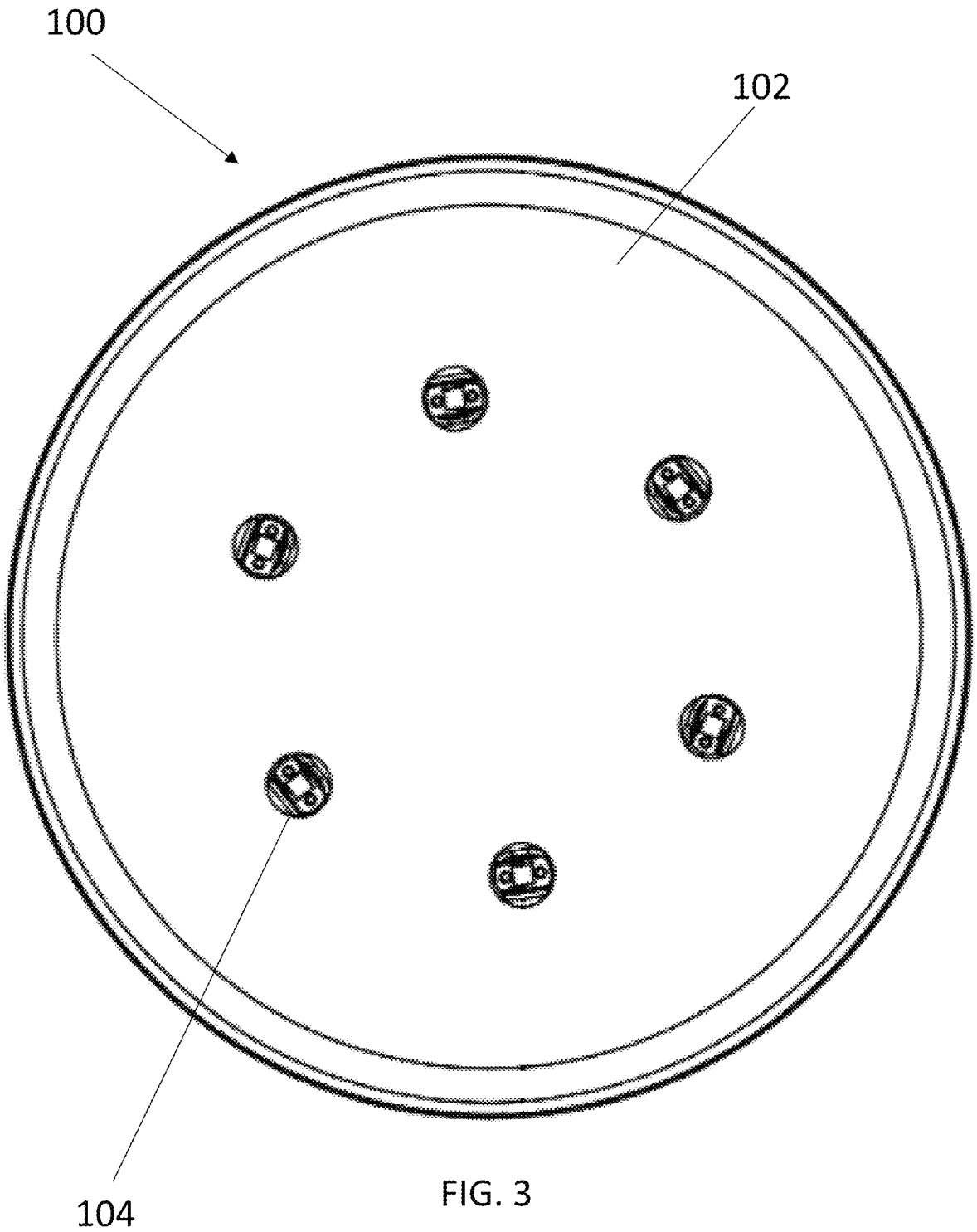
FIG. 3 illustrates a top view of a hockey puck according to one embodiment of the present invention.

FIG. 3 illustrates a top view of a hockey puck according to one embodiment of the present invention. Like a standard hockey puck, the puck 100 includes a top surface 102, a bottom surface, and a side wall connecting the top surface 102 and the bottom surface. In the embodiment shown in FIG. 3, a plurality of holes 104 extend into the top surface 102 of the puck 100 and/or the bottom surface of the puck 100 into the center of the puck 100. In another embodiment, in addition to or instead of the holes in the top surface 102 and/or bottom surface of the puck 100, the puck 100 includes a plurality of holes extending from the side wall of the puck 100 into the center of the puck 100.

Figure 4:
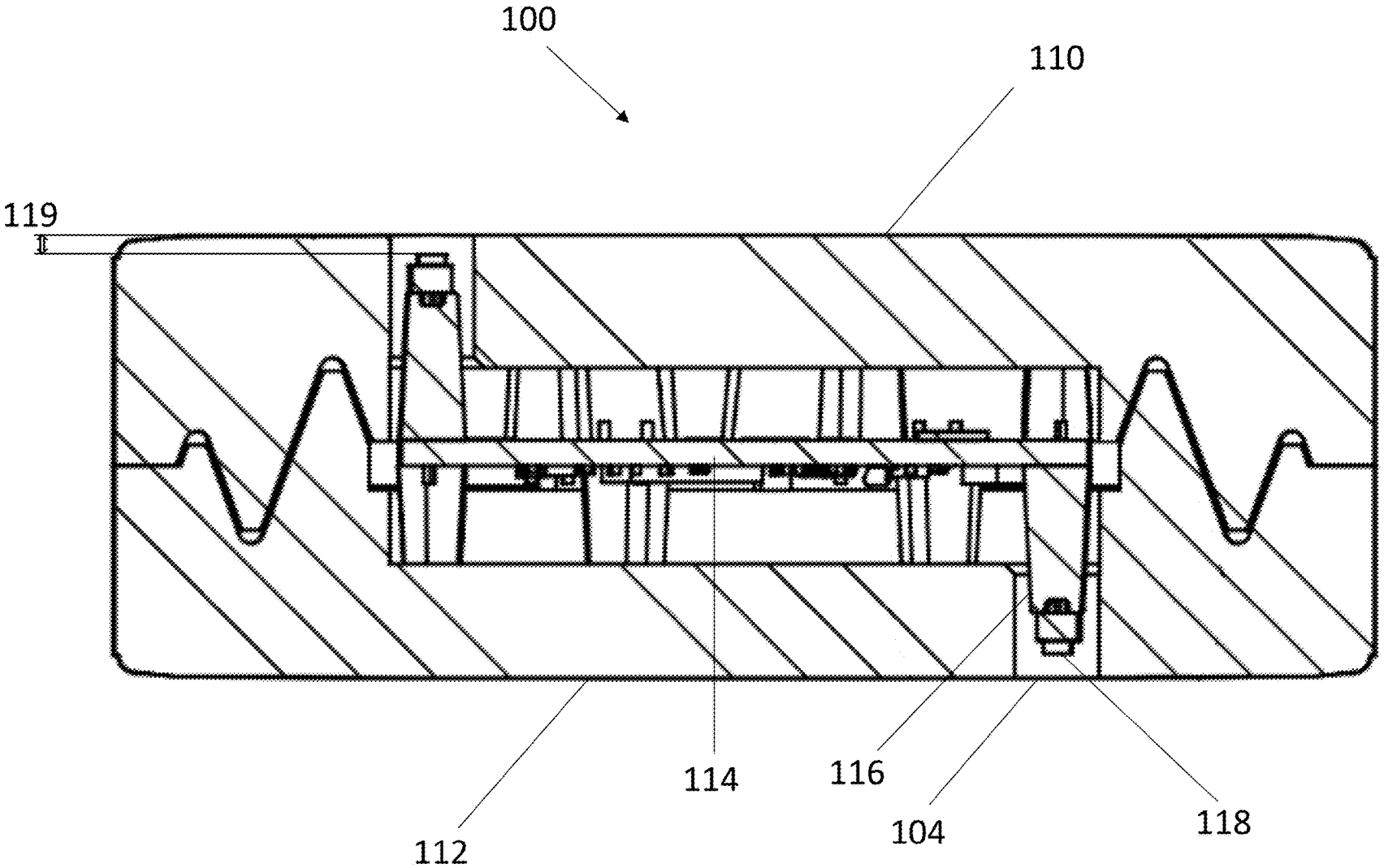
FIG. 4 illustrates a side sectional view of a hockey puck according to one embodiment of the present invention.

FIG. 4 illustrates a side sectional view of a hockey puck according to one embodiment of the present invention. The puck 100 is formed from a top component 110 joined to a bottom component 112. The top component 110 and the bottom component 112 form an interior void. An electronic module 114 is fit between the top component 110 and the bottom component 112. The electronic module 114 includes a plurality of protrusions 116 that extend into the plurality of holes 104. A surface-mounted LED 118 is attached to the end of each of the plurality of protrusions 116. The surface-mounted LED 118 is separated from the exterior of the puck 100 by a distance 119.

Figure 5:
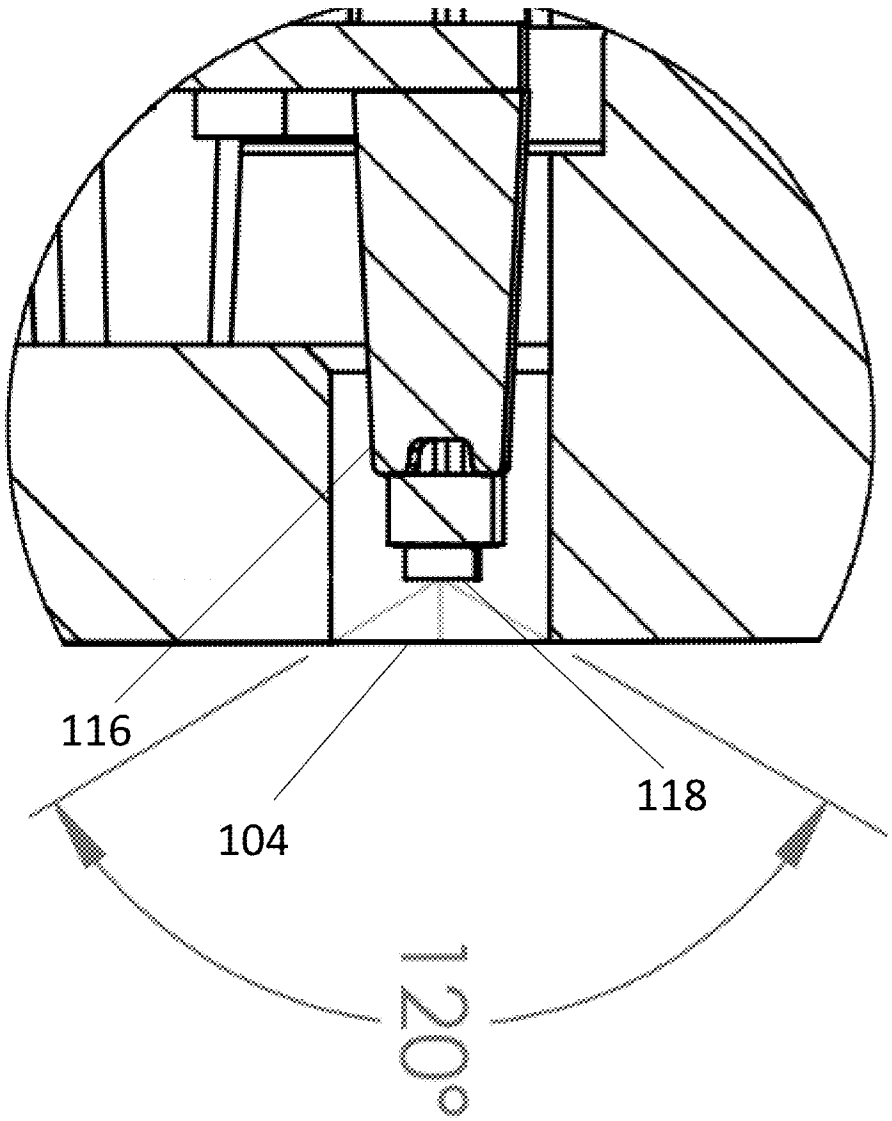
FIG. 5 illustrates angles at which electromagnetic radiation is able to travel from LEDs outside of openings in a hockey puck according to one embodiment of the present invention.

In one embodiment, the distance 119 is less than approximately 5 mm. In a preferred embodiment, the distance 119 is between approximately 2 mm and 3 mm. Positioning the surface-mounted LED 118 away from the exterior of the puck 100 by a short distance allows light to escape from the interior of the puck 100 at an arc greater than approximately 72°. Preferably, the arc is approximately 120°, as shown in FIG. 5. However, while it is advantageous for the surface-mounted LED 118 to be very close to the exterior of the puck 100, it is not advantageous for the surface-mounted LED 118 to be flush with the exterior of the puck 100. First, it is disadvantageous for the surface-mounted LED 118 to be very easily visible to an individual holding the puck 100, as it changes the aesthetic appearance of the puck 100. Second, each of the plurality of holes 104 is sealed with an epoxy plug in order to ensure that the puck 100 is waterproof, to prevent damage to the surface-mounted LED 118 and/or the electronic transmitter 114. Therefore, in one embodiment, the distance 119 between the surface-mounted LED 118 and the exterior of the puck 110 is greater than approximately 1 mm.

Figure 6:
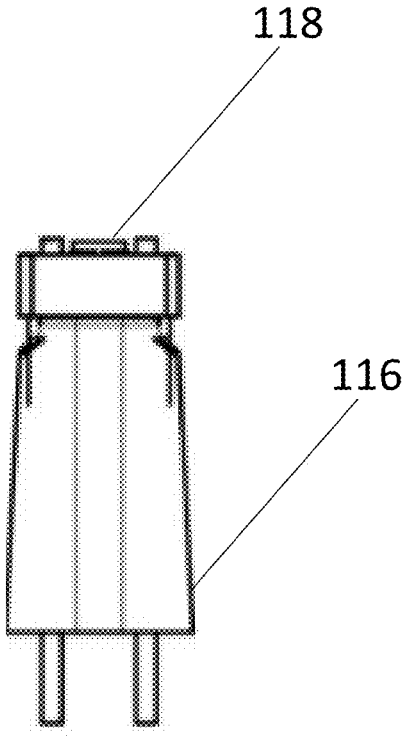
FIG. 6 illustrates an LED module for use in a hockey puck according to one embodiment of the present invention.

FIG. 6 illustrates an LED module for use in a hockey puck according to one embodiment of the present invention. As shown in FIG. 6, the surface-mounted LED 118 is attached to end of the protrusion 116 of the electronic module. The surface-mounted LED 118 is not encapsulated within a lens cap.

Figure 7:
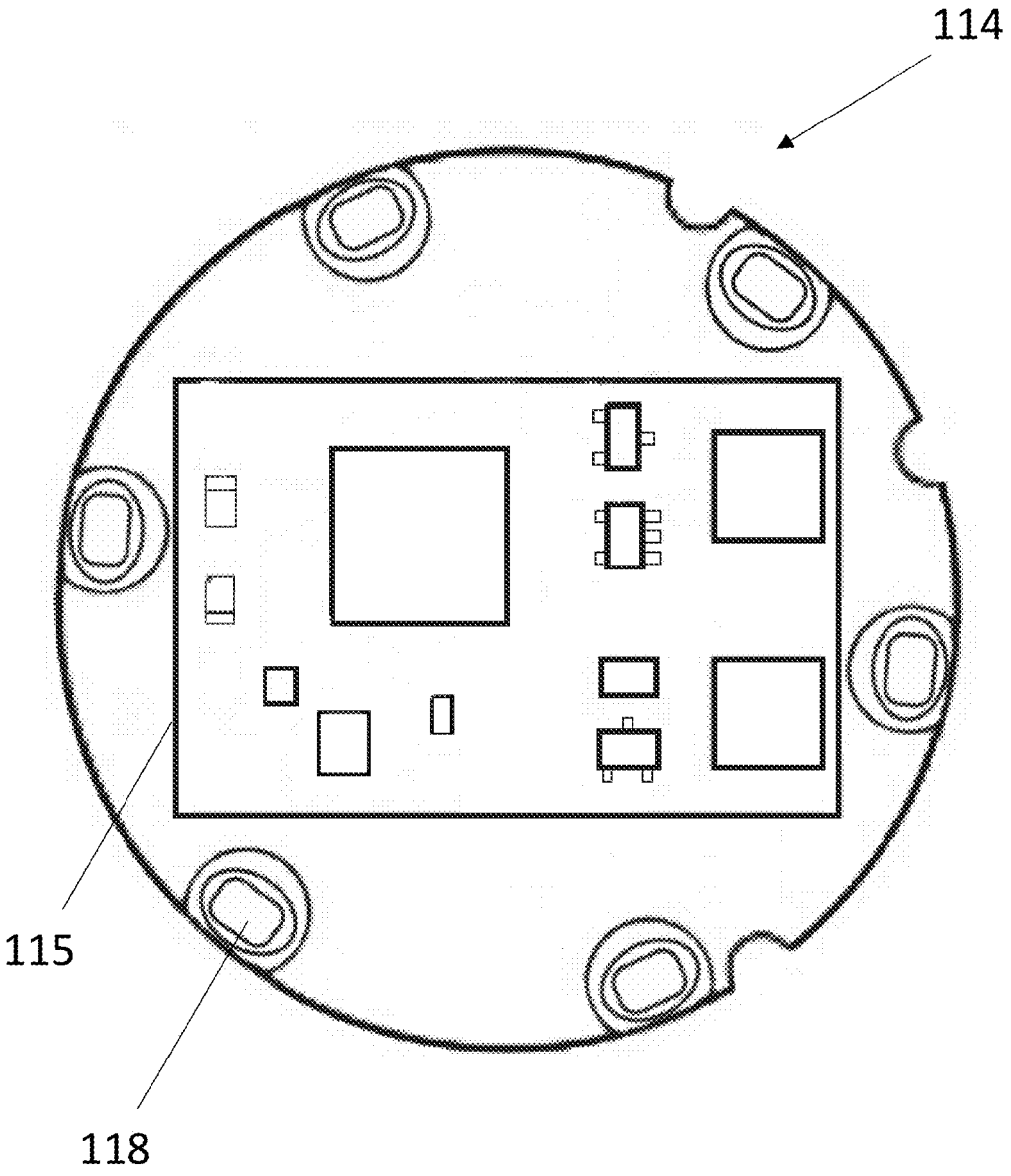
FIG. 7 illustrates a top view of an electronic module contained within a hockey puck according to one embodiment of the present invention.
Figure 8:
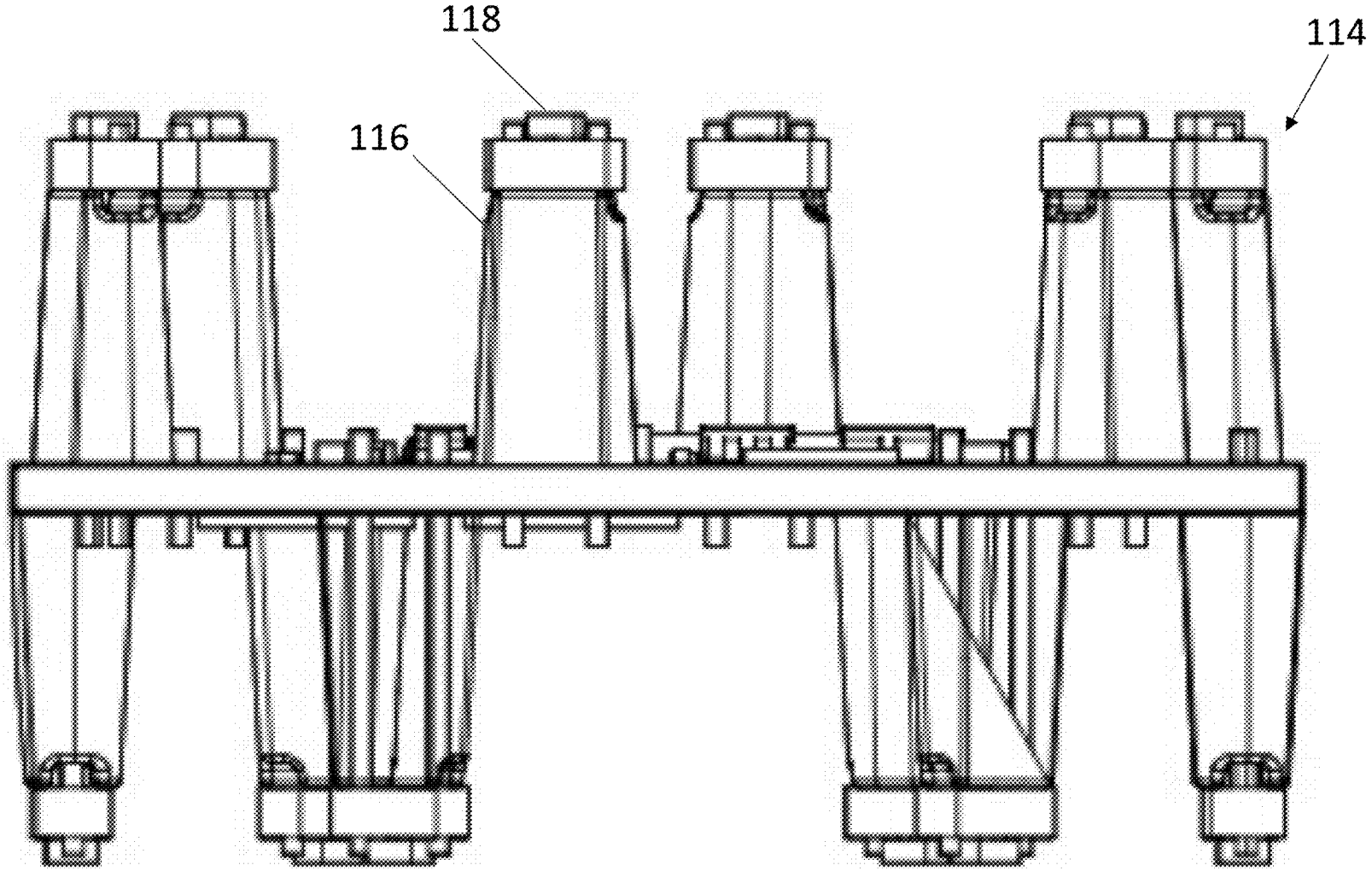
FIG. 8 illustrates an orthogonal side view of an electronic module contained within a hockey puck according to one embodiment of the present invention.

FIGS. 7-8 illustrate an electronic module contained within a hockey puck according to one embodiment of the present invention. The electronic module 114 includes an electronics chip 115, including a power supply, a processor, a memory, and/or a wireless antenna for communication via WI-FI or BLUETOOTH networks with at least one external device or server. In one embodiment, the plurality of protrusions 116 extend outwardly from the electronic module 114 in a ring around the perimeter of the electronic module 114. The surface-mounted LED 118 is attached to the end of each of the plurality of protrusions 116. In one embodiment, the surface-mounted LED 118 is operable to emit visible light and/or infrared light. One of ordinary skill in the art will understand that the range of wavelengths able to be emitted by the surface-mounted LED are not intended to be limiting and are able to include wavelengths outside of the ranges of visible light or infrared light, including, but not limited to, radio waves, microwaves and/or ultraviolet waves.

Figure 9:
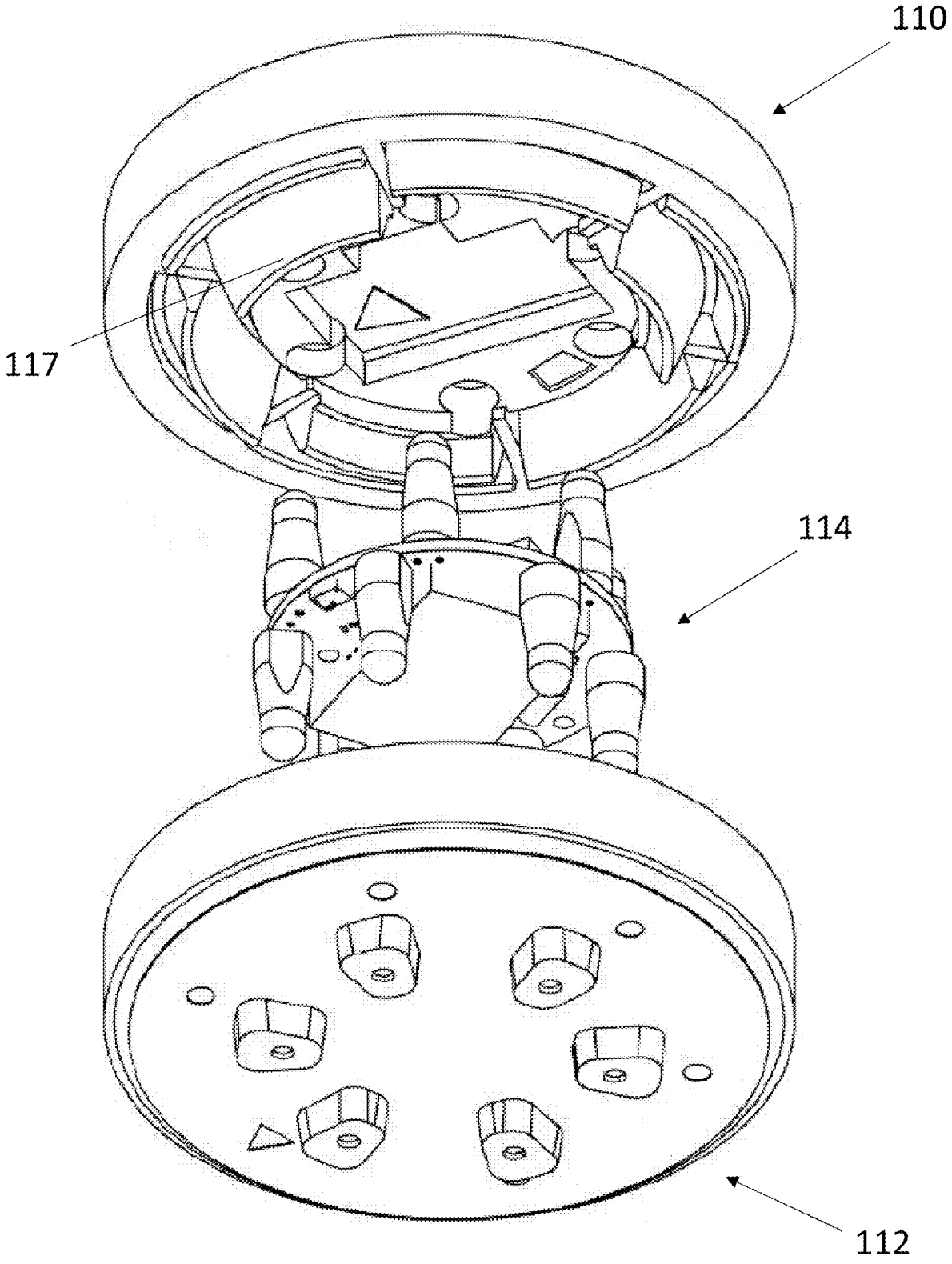
FIG. 9 illustrates an exploded view of a hockey puck according to one embodiment of the present invention.

FIG. 9 illustrates an exploded view of a hockey puck according to one embodiment of the present invention. The hockey puck is formed by the fusion of a top component 110 to a bottom component 112, with an electronic module 114 positioned between the top component 110 and the bottom component 112. In one embodiment, the top component 110 and the bottom component 112 each include a plurality of ridges and valleys 117 configured to matingly interconnect with corresponding ridges and valleys in the opposite subcomponent. In one embodiment, the hockey puck 100 is formed through the process described in U.S. Patent No. U.S. Pat. No. 11,202,949, which is incorporated herein by reference in its entirety, including, but not limited to, steps of molding the two subcomponents, fusing the subcomponents, and applying a surface treatment to the fused puck (e.g., etching, sanding, etc.).

Figure 10:
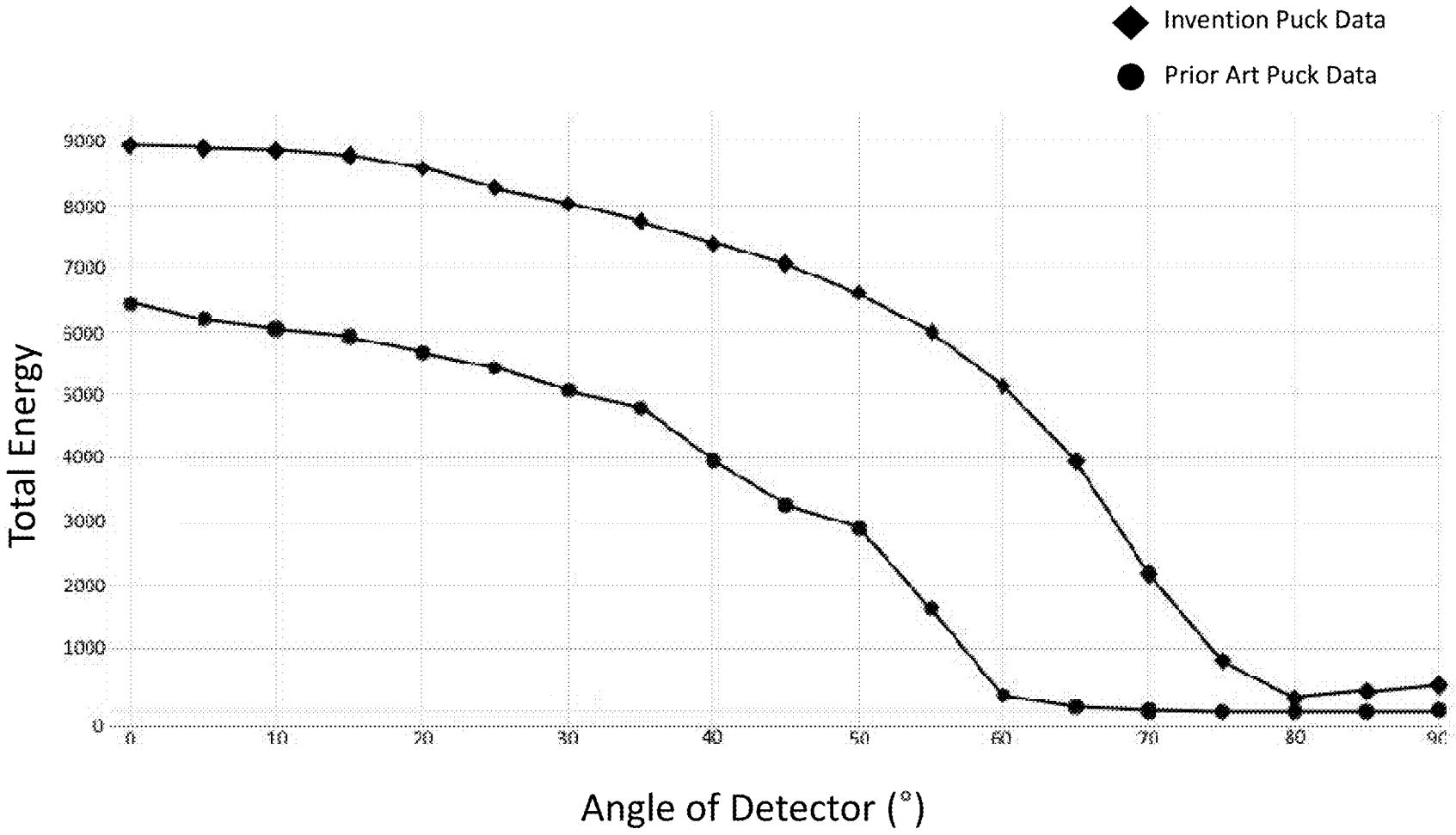
FIG. 10 illustrates a graph of total energy detected from a hockey puck versus angle at which the detector is positioned according to one embodiment of the present invention.

FIG. 10 illustrates a graph of total energy detected from a hockey puck versus angle at which the detector is positioned according to one embodiment of the present invention. Zero degrees on the x-axis of the graph of FIG. 10 is an amount of energy detected from the surface-mounted LED wherein the detector is aimed directly above the hole and is directly aimed at the hole. The x-axis denotes the angle of the detector relative to the hole. As shown in FIG. 10, there is a much starker decrease in detected energy from the LED in the prior-art puck, especially at an angle greater than about 35 degrees, while the puck according to the present invention does not see significant decline in observed energy until an angle of approximately 60 degrees. Therefore, the puck according to the present invention is much more visible form a wider range of angles relative to the prior art puck. Significantly, the total energy chart demonstrates that not only is the LED visible from a wider range of angles than the prior art, but is brighter even when viewed directly due to being closer to the surface of the puck.

Figure 11:
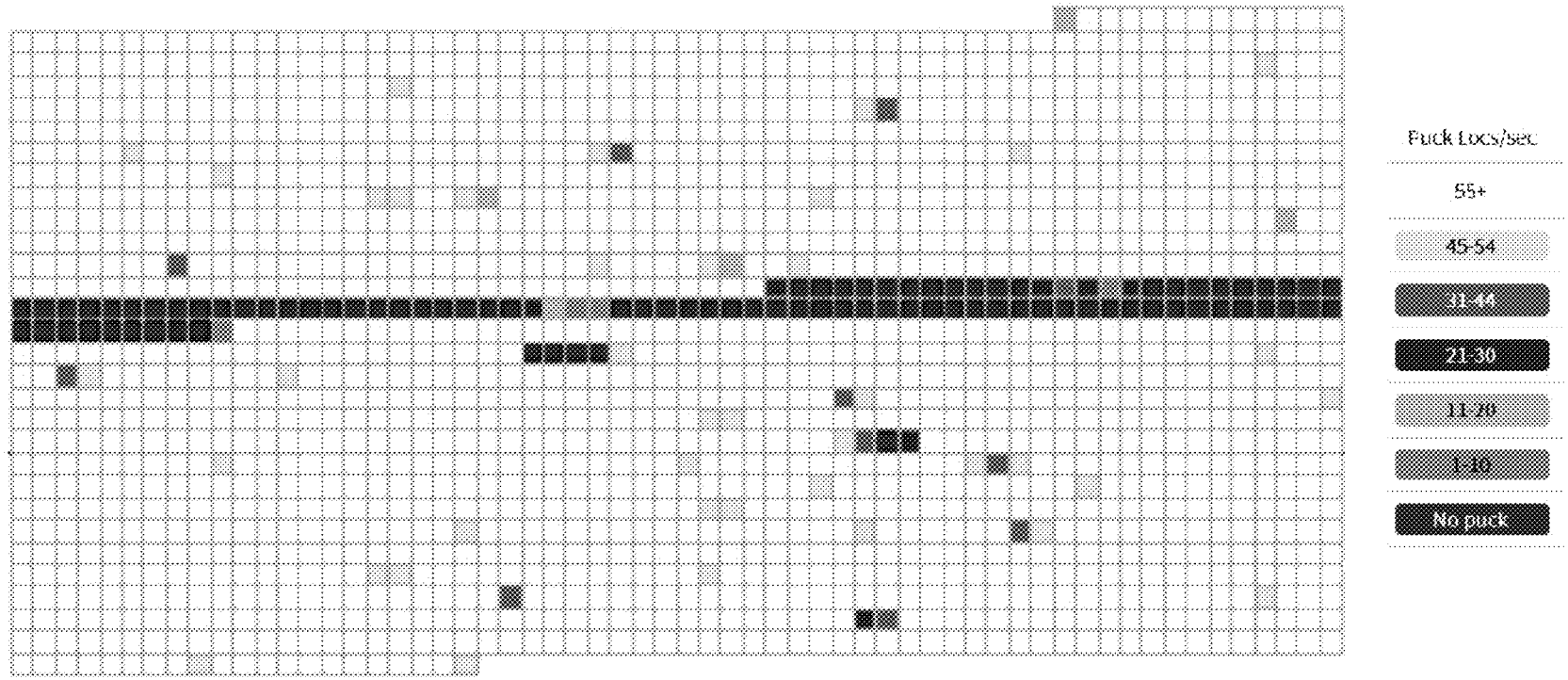
FIG. 11 illustrates a hockey puck missingness chart for a hockey puck according to one embodiment of the present invention.

FIG. 11 illustrates a hockey puck missingness chart for a hockey puck according to one embodiment of the present invention. Missingness charts have rows of 60 blocks each, where each row represents a minute of game time and each block represents a second of game time. Blocks are colored based on the number of successful location pings from the puck to a central computer within the corresponding second. The missingness chart in FIG. 11 is colored such that white signifies 55 or more location pings in a second, the light blue signifies 45-54 location pings in a second, green signifies 31-44 location pings in a second, dark blue signifies 21-30 location pings in a second, yellow signifies 11-20 location pings in a second, grey signifies 1-10 location pings in a second, and red represents no location pings in the second. The missingness chart in FIG. 11 shows puck visibility for an entire hockey game, with the section in red in the middle corresponding to a time when the puck was pocketed before being placed back on the ice. For the game time when the hockey puck was in play, the present system showed 95.9% of seconds with at least 55 pings, which represents a substantial improvement to the prior art.

Figure 12:
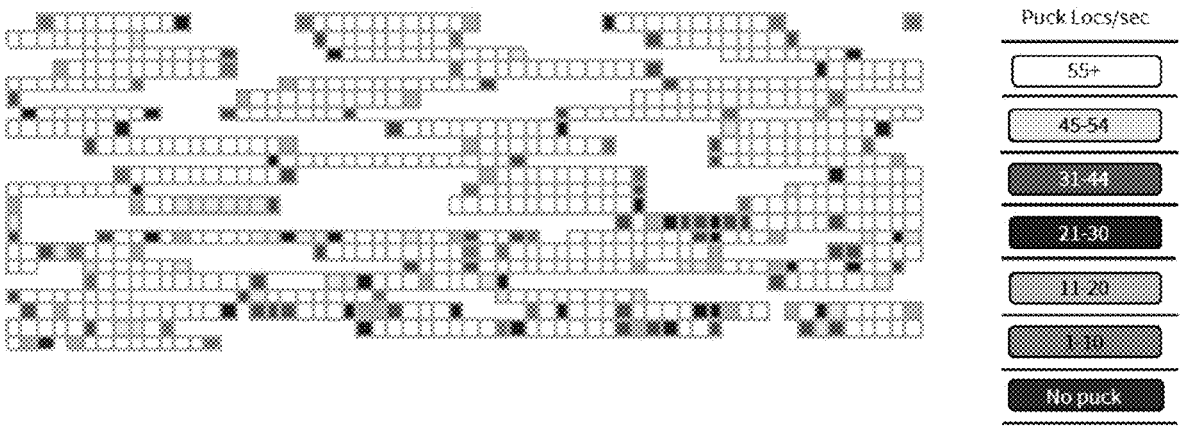
FIG. 12 illustrates a hockey puck missingness chart for a prior art hockey puck.
Figure 13:
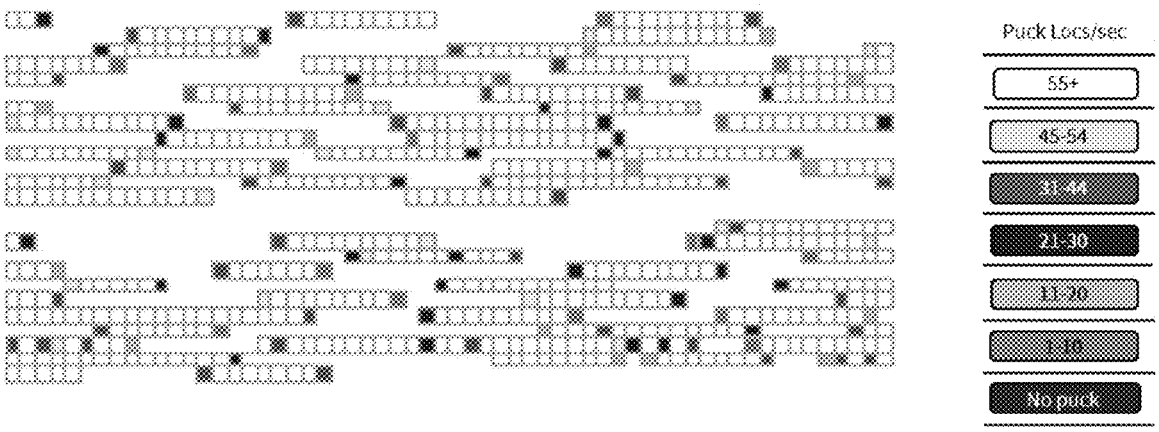
FIG. 13 illustrates a hockey puck missingness chart of a hockey puck according to one embodiment of the present invention.

FIG. 12 illustrates a hockey puck missingness chart for a prior art hockey puck, similar to that disclosed in US Patent Publication No. 2022/0105404, which is incorporated herein by reference in its entirety. FIG. 13 illustrates a hockey puck missingness chart of a hockey puck according to one embodiment of the present invention. The missingness charts in FIGS. 12 and 13 have been pruned to only show those times when an active test was being run using the pucks. FIGS. 12 and 13 show strong performance by both pucks, but a marked improvement for the visibility of the puck according to the present invention. With the exception of the first and last second of each test (which are easily cut off), the puck according to the present invention shows perfect 55 or more pings in nearly every test, while the prior art puck includes a number of tests with lower number of pings, including one test with a zero ping second. Based on the charts in FIGS. 12 and 13, the improvement provided by the present invention is clearly able to be seen.

Tests were performed comparing the detectability of the signals from the prior art puck and signals from the puck according to the present invention. For example, 55 tests were performed with 8 cameras each in different positions to observe each puck, for a total of 394 camera observations. Out of the 394 camera observations, 387 showed higher average energy from the puck according to the present invention.

Figure 14:
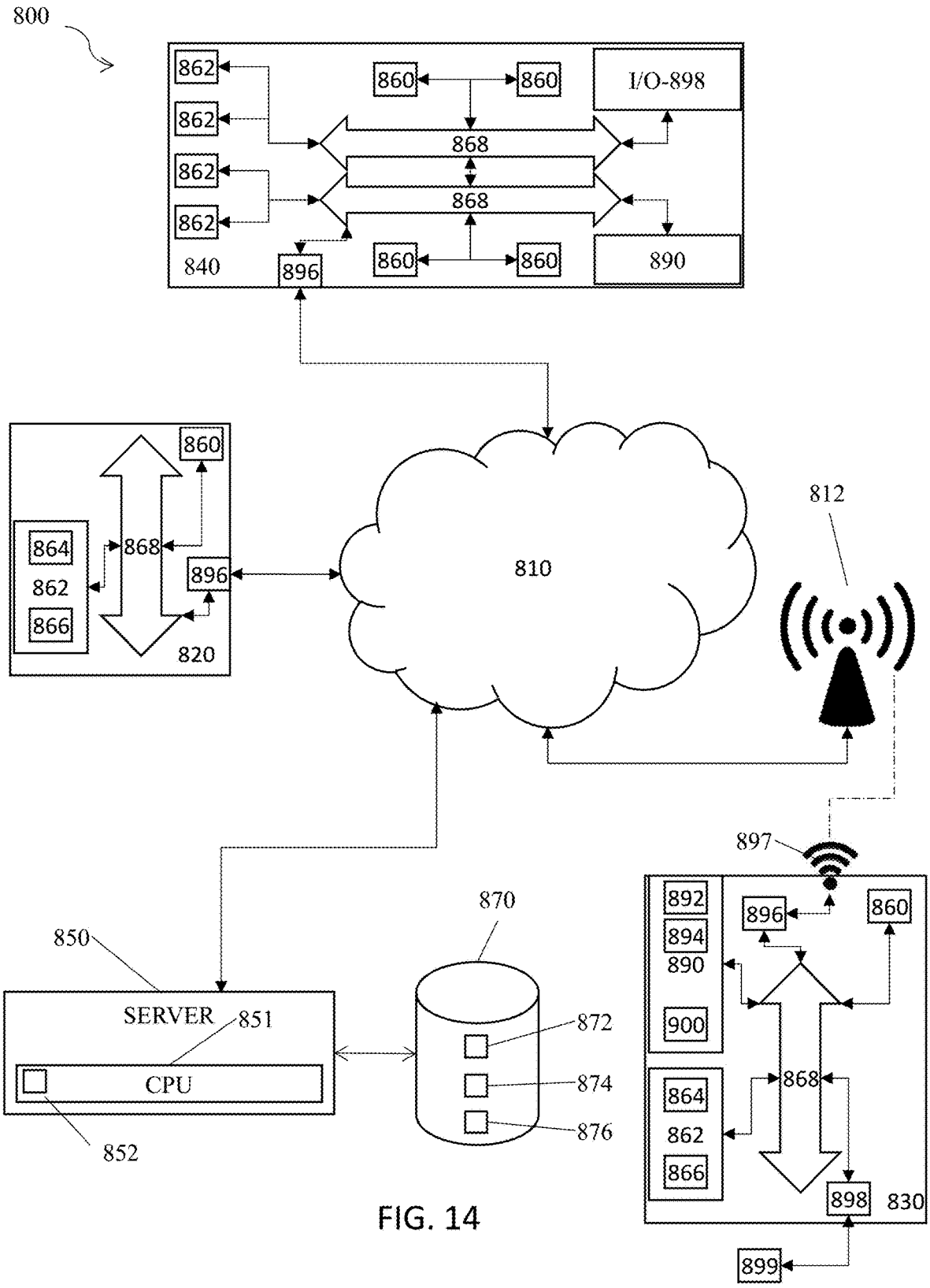
FIG. 14 is a schematic diagram of a system of the present invention.

FIG. 14 is a schematic diagram of an embodiment of the invention illustrating a computer system, generally described as 800, having a network 810, a plurality of computing devices 820, 830, 840, a server 850, and a database 870.

The server 850 is constructed, configured, and coupled to enable communication over a network 810 with a plurality of computing devices 820, 830, 840. The server 850 includes a processing unit 851 with an operating system 852. The operating system 852 enables the server 850 to communicate through network 810 with the remote, distributed user devices. Database 870 is operable to house an operating system 872, memory 874, and programs 876.

In one embodiment of the invention, the system 800 includes a network 810 for distributed communication via a wireless communication antenna 812 and processing by at least one mobile communication computing device 830. Alternatively, wireless and wired communication and connectivity between devices and components described herein include wireless network communication such as WI-FI, WORLDWIDE INTEROPERABILITY FOR MICROWAVE ACCESS (WIMAX), Radio Frequency (RF) communication including RF identification (RFID), NEAR FIELD COMMUNICATION (NFC), BLUETOOTH including BLUETOOTH LOW ENERGY (BLE), ZIGBEE, Infrared (IR) communication, cellular communication, satellite communication, Universal Serial Bus (USB), Ethernet communications, communication via fiber-optic cables, coaxial cables, twisted pair cables, and/or any other type of wireless or wired communication. In another embodiment of the invention, the system 800 is a virtualized computing system capable of executing any or all aspects of software and/or application components presented herein on the computing devices 820, 830, 840. In certain aspects, the computer system 800 is operable to be implemented using hardware or a combination of software and hardware, either in a dedicated computing device, or integrated into another entity, or distributed across multiple entities or computing devices.

By way of example, and not limitation, the computing devices 820, 830, 840 are intended to represent various forms of electronic devices including at least a processor and a memory, such as a server, blade server, mainframe, mobile phone, personal digital assistant (PDA), smartphone, desktop computer, netbook computer, tablet computer, workstation, laptop, and other similar computing devices. The components shown here, their connections and relationships, and their functions, are meant to be exemplary only, and are not meant to limit implementations of the invention described and/or claimed in the present application.

In one embodiment, the computing device 820 includes components such as a processor 860, a system memory 862 having a random access memory (RAM) 864 and a read-only memory (ROM) 866, and a system bus 868 that couples the memory 862 to the processor 860. In another embodiment, the computing device 830 is operable to additionally include components such as a storage device 890 for storing the operating system 892 and one or more application programs 894, a network interface unit 896, and/or an input/output controller 898. Each of the components is operable to be coupled to each other through at least one bus 868. The input/output controller 898 is operable to receive and process input from, or provide output to, a number of other devices 899, including, but not limited to, alphanumeric input devices, mice, electronic styluses, display units, touch screens, signal generation devices (e.g., speakers), or printers.

By way of example, and not limitation, the processor 860 is operable to be a general-purpose microprocessor (e.g., a central processing unit (CPU)), a graphics processing unit (GPU), a microcontroller, a Digital Signal Processor (DSP), an Application Specific Integrated Circuit (ASIC), a Field Programmable Gate Array (FPGA), a Programmable Logic Device (PLD), a controller, a state machine, gated or transistor logic, discrete hardware components, or any other suitable entity or combinations thereof that can perform calculations, process instructions for execution, and/or other manipulations of information.

In another implementation, shown as 840 in FIG. 14, multiple processors 860 and/or multiple buses 868 are operable to be used, as appropriate, along with multiple memories 862 of multiple types (e.g., a combination of a DSP and a microprocessor, a plurality of microprocessors, one or more microprocessors in conjunction with a DSP core).

Also, multiple computing devices are operable to be connected, with each device providing portions of the necessary operations (e.g., a server bank, a group of blade servers, or a multi-processor system). Alternatively, some steps or methods are operable to be performed by circuitry that is specific to a given function.

According to various embodiments, the computer system 800 is operable to operate in a networked environment using logical connections to local and/or remote computing devices 820, 830, 840 through a network 810. A computing device 830 is operable to connect to a network 810 through a network interface unit 896 connected to a bus 868. Computing devices are operable to communicate communication media through wired networks, direct-wired connections or wirelessly, such as acoustic, RF, or infrared, through an antenna 897 in communication with the network antenna 812 and the network interface unit 896, which are operable to include digital signal processing circuitry when necessary. The network interface unit 896 is operable to provide for communications under various modes or protocols.

In one or more exemplary aspects, the instructions are operable to be implemented in hardware, software, firmware, or any combinations thereof. A computer readable medium is operable to provide volatile or non-volatile storage for one or more sets of instructions, such as operating systems, data structures, program modules, applications, or other data embodying any one or more of the methodologies or functions described herein. The computer readable medium is operable to include the memory 862, the processor 860, and/or the storage media 890 and is operable be a single medium or multiple media (e.g., a centralized or distributed computer system) that store the one or more sets of instructions 900. Non-transitory computer readable media includes all computer readable media, with the sole exception being a transitory, propagating signal per se. The instructions 900 are further operable to be transmitted or received over the network 810 via the network interface unit 896 as communication media, which is operable to include a modulated data signal such as a carrier wave or other transport mechanism and includes any delivery media. The term "modulated data signal" means a signal that has one or more of its characteristics changed or set in a manner as to encode information in the signal.

Storage devices 890 and memory 862 include, but are not limited to, volatile and non-volatile media such as cache, RAM, ROM, EPROM, EEPROM, FLASH memory, or other solid state memory technology; discs (e.g., digital versatile discs (DVD), HD-DVD, BLU-RAY, compact disc (CD), or CD-ROM) or other optical storage; magnetic cassettes, magnetic tape, magnetic disk storage, floppy disks, or other magnetic storage devices; or any other medium that can be used to store the computer readable instructions and which can be accessed by the computer system 800.

In one embodiment, the computer system 800 is within a cloud-based network. In one embodiment, the server 850 is a designated physical server for distributed computing devices 820, 830, and 840. In one embodiment, the server 850 is a cloud-based server platform. In one embodiment, the cloud-based server platform hosts serverless functions for distributed computing devices 820, 830, and 840.

In another embodiment, the computer system 800 is within an edge computing network. The server 850 is an edge server, and the database 870 is an edge database. The edge server 850 and the edge database 870 are part of an edge computing platform. In one embodiment, the edge server 850 and the edge database 870 are designated to distributed computing devices 820, 830, and 840. In one embodiment, the edge server 850 and the edge database 870 are not designated for distributed computing devices 820, 830, and 840. The distributed computing devices 820, 830, and 840 connect to an edge server in the edge computing network based on proximity, availability, latency, bandwidth, and/or other factors.

It is also contemplated that the computer system 800 is operable to not include all of the components shown in FIG. 14, is operable to include other components that are not explicitly shown in FIG. 14, or is operable to utilize an architecture completely different than that shown in FIG. 14. The various illustrative logical blocks, modules, elements, circuits, and algorithms described in connection with the embodiments disclosed herein are operable to be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application (e.g., arranged in a different order or partitioned in a different way), but such implementation decisions should not be interpreted as causing a departure from the scope of the present invention.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A hockey puck, comprising:

a first subcomponent matingly attached to a second subcomponent; and a signal transmitter operable to generate and emit electromagnetic radiation;

wherein the signal transmitter includes at least one power source and at least one protrusion of an electronic module of the signal transmitter attached to at least one diode;

wherein the at least one diode is surface-mounted to the at least one protrusion of the electronic module of the signal transmitter;

wherein an interior void is formed between the first subcomponent and the second subcomponent;

wherein the signal transmitter is sized to fit within the interior void;

wherein the first subcomponent and/or the second subcomponent include one or more holes extending from an external surface of either subcomponent to the interior void;

wherein the at least one protrusion of the signal transmitter extends into the one or more holes of the first subcomponent and/or the second subcomponent;

wherein the at least one diode is positioned between approximately 2 mm and approximately 3 mm from an external surface of the hockey puck;

wherein the at least one diode is operable to generate visible and/or infrared electromagnetic radiation; and wherein the at least one diode does not include a lens cap.

2. The hockey puck of claim 1, wherein the hockey puck includes a top surface, a bottom surface, and a side wall connecting the top surface and the bottom surface, and wherein the one or more holes extend through the top surface and/or the bottom surface of the hockey puck.

3. The hockey puck of claim 1, wherein the hockey puck includes a top surface, a bottom surface, and a side wall connecting the top surface and the bottom surface, and wherein the one or more holes extend through the side wall of the hockey puck.

4. The hockey puck of claim 1, wherein the at least one diode includes at least eight diodes.

5. The hockey puck of claim 1, wherein an external opening of each of the one or more holes is sealed with a translucent epoxy.

6. The hockey puck of claim 1, wherein the signal transmitter includes at least one wireless antenna configured to communicate puck data via a WI-FI network and/or a BLUETOOTH network to a server.

7. The hockey puck of claim 1, wherein the electronic module of the signal transmitter is a circuit board of the signal transmitter.

8. A hockey puck, comprising:

a first subcomponent matingly attached to a second subcomponent; and a signal transmitter operable to generate and emit electromagnetic radiation;

wherein the signal transmitter includes at least one power source and at least one protrusion of an electronic module of the signal transmitter attached to at least one diode;

wherein the at least one diode is surface-mounted to the at least one protrusion of the electronic module of the signal transmitter;

wherein an interior void is formed between the first subcomponent and the second subcomponent;

wherein the signal transmitter is sized to fit within the interior void;

wherein the first subcomponent and/or the second subcomponent include one or more holes extending from an external surface of either subcomponent to the interior void;

wherein the at least one protrusion of the signal transmitter extends into the one or more holes of the first subcomponent and/or the second subcomponent;

wherein the at least one diode is positioned less than approximately 5 mm from an external surface of the hockey puck;

wherein an external opening of each of the one or more holes is sealed with a translucent epoxy;

wherein the at least one diode does not include a lens cap; and wherein the at least one diode is operable to generate visible and/or infrared electromagnetic radiation.

9. The hockey puck of claim 8, wherein the hockey puck includes a top surface, a bottom surface, and a side wall connecting the top surface and the bottom surface, and wherein the one or more holes extend through the top surface and/or the bottom surface of the hockey puck.

10. The hockey puck of claim 8, wherein the hockey puck includes a top surface, a bottom surface, and a side wall connecting the top surface and the bottom surface, and wherein the one or more holes extend through the side wall of the hockey puck.

11. The hockey puck of claim 8, wherein the at least one diode includes at least eight diodes.

12. The hockey puck of claim 8, wherein the at least one diode is positioned greater than approximately 1 mm from the external surface of the hockey puck.

13. The hockey puck of claim 8, wherein the signal transmitter includes at least one wireless antenna configured to communicate puck data via a WI-FI network and/or a BLUETOOTH network to a server.

14. The hockey puck of claim 8, wherein the electronic module of the signal transmitter is a circuit board of the signal transmitter.

15. A hockey puck, comprising:

a first subcomponent matingly attached to a second subcomponent; and a signal transmitter operable to generate and emit electromagnetic radiation;

wherein the signal transmitter includes at least one power source and at least one protrusion of an electronic module of the signal transmitter attached to at least one diode;

wherein the at least one diode is surface-mounted to the at least one protrusion of the electronic module of the signal transmitter;

wherein an interior void is formed between the first subcomponent and the second subcomponent;

wherein the signal transmitter is sized to fit within the interior void;

wherein the first subcomponent and/or the second subcomponent include one or more holes extending from an external surface of either subcomponent to the interior void;

wherein the at least one protrusion of the signal transmitter extends into the one or more holes of the first subcomponent and/or the second subcomponent;

wherein the at least one diode is positioned less than approximately 5 mm from an external surface of the hockey puck;

wherein the at least one diode does not include a lens cap;

wherein the at least one diode is operable to generate visible and/or infrared electromagnetic radiation; and wherein the visible and/or infrared electromagnetic radiation is detectable in a 120° cone through the one or more holes.

16. The hockey puck of claim 15, wherein the hockey puck includes a top surface, a bottom surface, and a side wall connecting the top surface and the bottom surface, and wherein the one or more holes extend through the top surface and/or the bottom surface of the hockey puck.

17. The hockey puck of claim 15, wherein the hockey puck includes a top surface, a bottom surface, and a side wall connecting the top surface and the bottom surface, and wherein the one or more holes extend through the side wall of the hockey puck.

18. The hockey puck of claim 15, wherein the at least one diode includes at least eight diodes.

19. The hockey puck of claim 15, wherein an external opening of each of the one or more holes is sealed with a translucent epoxy.

20. The hockey puck of claim 15, wherein the at least one diode is positioned greater than approximately 1 mm from the external surface of the hockey puck.

* * * * *